United States Patent [19]

Ozawa

[11] Patent Number: 5,027,405

[45] Date of Patent: Jun. 25, 1991

[54] COMMUNICATION SYSTEM CAPABLE OF IMPROVING A SPEECH QUALITY BY A PAIR OF PULSE PRODUCING UNITS

[75] Inventor: Kazunori Ozawa, Tokyo, Japan

[73] Assignee: NEC Corporation, Tokyo, Japan

[21] Appl. No.: 450,983

[22] Filed: Dec. 15, 1989

[30] Foreign Application Priority Data

Mar. 22, 1989 [JP] Japan ..... 1-71203

[51] Int. Cl.[5] ..... G10L 5/00

[52] U.S. Cl. ..... 381/35; 381/40; 381/49; 381/38

[58] Field of Search ..... 381/29-51

[56] References Cited

U.S. PATENT DOCUMENTS

| | | | |
|---|---|---|---|
| 4,701,954 | 10/1987 | Atal | 381/49 |
| 4,797,926 | 1/1989 | Bronson | 381/36 |
| 4,864,621 | 9/1989 | Boyd | 381/38 |
| 4,881,267 | 11/1989 | Taguchi | 381/40 |

*Primary Examiner*—Emanuel S. Kemeny

*Attorney, Agent, or Firm*—Sughrue, Mion, Zinn, Macpeak & Seas

[57] ABSTRACT

A second approximation of the multipulse excitation signal is derived from a difference signal developed from use of a first approximation of the multipulse excitation signal. Also, spectrum parameters are weighted by a periodicity measure.

4 Claims, 4 Drawing Sheets

COMMUNICATION SYSTEM CAPABLE OF IMPROVING A SPEECH QUALITY BY A PAIR OF PULSE PRODUCING UNITS

BACKGROUND OF THE INVENTION

This invention relates to a communication system which comprises an encoder device for encoding a sequence of input digital speech signals into a set of excitation multipulses and/or a decoder device communicable with the encoder device.

As known in the art, a conventional communication system of the type described is helpful for transmitting a speech signal at a low transmission bit rate, such as 4.8 kb/s from a transmitting end to a receiving end. The transmitting and the receiving ends comprise an encoder device and a decoder device which are operable to encode and decode the speech signals, respectively, in the manner which will presently be described more in detail. A wide variety of such systems have been proposed to improve a speech quality reproduced in the decoder device and to reduce a transmission bit rate.

Among others, there has been known a pitch interpolation multi-pulse system which has been proposed in Japanese Unexamined Patent Publications Nos. Syō 61-15000 and 62-038500, namely, 15000/1986 and 038500/1987 which may be called first and second references, respectively. In this pitch interpolation multipulse system, the encoder device is supplied with a sequence of input digital speech signals at every frame of, for example, 20 milliseconds and extracts spectrum parameter and a pitch parameter which will be called first and second primary parameters, respectively. The spectrum parameter is representative of a spectrum envelope of a speech signal specified by the input digital speech signal sequence while the pitch parameter is representative of a pitch of the speech signal. Thereafter, the input digital speech signal sequence is classified into a voiced sound and an unvoiced sound which last for voiced and unvoiced durations, respectively. In addition, the input digital speech signal sequence is divided at every frame into a plurality of pitch durations which may be referred to as subframes, respectively. Under the circumstances, operation is carried out in the encoder device to calculate a set of excitation multipulses representative of a sound source signal specified by the input digital speech signal sequence.

More specifically, the sound source signal is represented for the voiced duration by the excitation multipulse set which is calculated with respect to a selected one of the pitch durations that may be called a representative duration. From this fact, it is understood that each set of the excitation multipulses is extracted from intermittent ones of the subframes. Subsequently, an amplitude and a location of each excitation multipulse of the set are transmitted from the transmitting end to the receiving end along with the spectrum and the pitch parameters. On the other hand, a sound source signal of a single frame is represented for the unvoiced duration by a small number of excitation multipulses and a noise signal. Thereafter, the amplitude and the location of each excitation multipulse is transmitted for the unvoiced duration together with a gain and an index of the noise signal. At any rate, the amplitudes and the locations of the excitation multipulses, the spectrum and the pitch parameters, and the gains and the indices of the noise signals are sent as a sequence of output signals from the transmitting end to a receiving end comprising a decoder device.

On the receiving end, the decoder device is supplied with the output signal sequence as a sequence of reception signals which carries information related to sets of excitation multipulses extracted from frames, as mentioned above. Let consideration be made about a current set of the excitation multipulses extracted from a representative duration of a current one of the frames and a next set of the excitation multipulses extracted from a representative duration of a next one of the frames following the current frame. In this event, interpolation is carried out for the voiced duration by the use of the amplitudes and the locations of the current and the next sets of the excitation multipulses to reconstruct excitation multipulses in the remaining subframes except the representative durations and to reproduce a sequence of driving sound source signals for each frame. On the other and, a sequence of driving sound source signals for each frame is reproduced for an unvoiced duration by the use of indices and gains of the excitation multipulses and the noise signals.

Thereafter, the driving sound source signals thus reproduced are given to a synthesis filter formed by the use of a spectrum parameter and are synthesized into a synthesized sound signal.

With this structure, each set of the excitation multipulses is intermittently extracted from each frame in the encoder device and is reproduced into the synthesized sound signal by an interpolation technique in the decoder device. Herein, it is to be noted that intermittent extraction of the excitation multipulses makes it difficult to reproduce the driving sound source signal in the decoder device at a transient portion at which the sound source signal is changed in its characteristic. Such a transient portion appears when a vowel is changed to another vowel on concatenation of vowels in the speech signal and when a voiced sound is changed to another voiced sound. In a frame including such a transient portion, the driving sound source signals reproduced by the use of the interpolation technique is terribly different from actual sound source signals, which results in degradation of the synthesized sound signal in quality.

It is mentioned here that the spectrum parameter for a spectrum envelope is generally calculated in an encoder device by analyzing the speech signals by the use of a linear prediction coding (LPC) technique and is used in a decoder device to form a synthesis filter. Thus, the synthesis filter is formed by the spectrum parameter derived by the use of the linear prediction coding technique and has a filter characteristic determined by the spectrum envelope. However, when female sounds, in particular, "i" and "u" are analyzed by the linear prediction coding technique, it has been pointed out that an adverse influence appears in a fundamental wave and its harmonic waves of a pitch frequency. Accordingly, the synthesis filter has a band width which is very narrower than a practical band width determined by a spectrum envelope of practical speech signals. Particularly, the band width of the synthesis filter becomes extremely narrow in a frequency band which corresponds to a first formant frequency band. As a result, no periodicity of a pitch appears in a sound source signal. Therefore, the speech quality of the synthesized sound signal is unfavorably degraded when the sound source signals are represented by the excitation multipulses extracted by the use of the interpolation technique on the assumption of the periodicity of the sound source.

SUMMARY OF THE INVENTION

It is an object of this invention to provide a communication system which is capable of improving a speech quality when input digital speech signals are encoded at a transmitting end and reproduced at a receiving end.

It is another object of this invention to provide an encoder which is used in the transmitting end of the communication system and which can encode the input digital speech signals into a sequence of output signals at a comparatively small amount of calculation so as to improve the speech quality.

It is still another object of this invention to provide a decoder device which is used in the receiving end and which can reproduce a synthesized sound signal at a high speech quality.

An encoder device to which this invention is applicable is supplied with a sequence of input digital speech signals at every frame to produce a sequence of output signals. The encoder device comprises parameter calculation means responsive to the input digital speech signals for calculating first and second primary parameters which specify a spectrum envelope and a pitch of the input digital speech signals at every frame to produce first and second parameter signals representative of the spectrum envelope and the pitch parameters, respectively. The encoder device further comprises calculation means coupled to the parameter calculation means for calculating a set of calculation result signals representative of the digital speech signals, and output signal producing means for producing the set of the calculation result signals as the output signal sequence.

According to an aspect of this invention, the calculation means comprises primary pulse producing means responsive to the digital speech signals and the first and the second parameter signals for producing a first set of prediction excitation multipulses, as a primary sound source signal, with respect to a preselected one of subframes which result from dividing every frames and each of which is shorter than the frame and for producing a sequence of primary synthesized signals specified by the first set of prediction excitation multipulses and the spectrum envelope and the pitch parameters, subtraction means coupled to the primary pulse producing means for subtracting the primary synthesized signals from the digital speech signals to produce a sequence of difference signals representative of differences between the primary synthesized signals and the digital speech signals, secondary pulse producing means coupled to the subtraction means and responsive to the difference signals and the first and the second parameter signals for producing a second set of secondary excitation multipulses, as a secondary sound source signal, as the set of calculation result signals, and means for supplying a combination of the first set of prediction excitation multipulses, the second set of secondary excitation multipulses, and the first and the second parameter signals to the output signal producing means as the output signal sequence.

Figure 1:
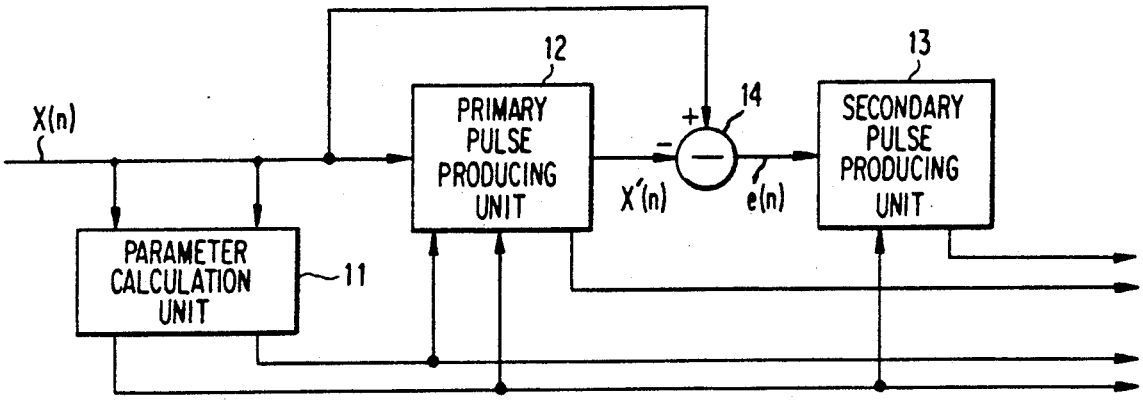
FIG. 1 is a block diagram for use in describing principles of an encoder device of this invention.
Figure 2A:
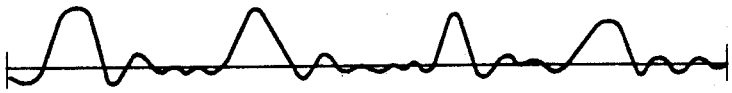
FIG. 2 is a time chart for use in describing an operation of the encoder device illustrated in FIG. 1.
Figure 2B:
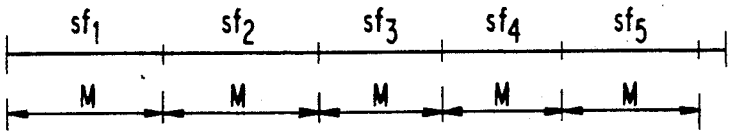
Figure 2C:
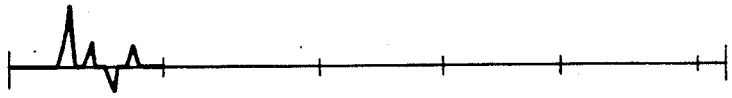
Figure 2D:
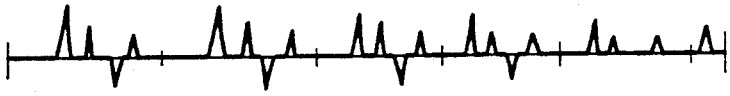
Figure 2E:
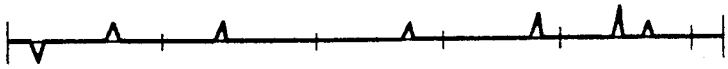

DESCRIPTION OF THE PREFERRED EMBODIMENT:

Referring to FIG. 1, principles of the present invention will be described at first. An encoder device according to this invention comprises a parameter calculation unit 11, a primary pulse producing unit 12, a secondary pulse producing unit 13, and a subtracter 14. The encoder device is supplied with a sequence of input digital speech signals X(n) where n represents sampling instants. The input digital speech signals X(n) is divisible into a plurality of frames and is assumed to be sent from an external device, such as an analog-to-digital converter (not shown) to the encoder device. Each frame may have an interval of, for example, 20 milliseconds. The parameter calculation unit 11 comprises an LPC analyzer (not shown) and a pitch parameter calculator (not shown) both of which are given the input digital speech signals X(n) in parallel to calculate LPC parameters $a_i$ and pitch parameters in a known manner. The LPC parameters $a_i$ and the pitch parameters will be referred to as first and second parameter signals, respectively.

Specifically, the LPC parameters $a_i$ are representative of a spectrum envelope of the input digital speech signals at every frame and may be called a spectrum parameter. Calculation of the LPC parameters $a_i$ are described in detail in the first and the second references which are referenced in the preamble of the instant specification. The LPC parameters may be replaced by LSP parameters, formant, or LPC cepstrum parameters. The first parameter signal is sent to the primary and the secondary pulse producing units 12 and 13. The pitch parameters are representative of an average pitch period M and pitch coefficients b of the input digital speech signals at every frame and are calculated by an autocorrelation method. The second parameter signal is sent to the primary pulse producing unit 12.

As will later be described in detail, the primary pulse producing unit 12 comprises a perceptual weighting circuit, a primary pulse calculator, a pitch reproduction filter, and a spectrum envelope synthesis filter. As known in the art, the perceptual weighting filter weights the input digital speech signals X(n) and produces weighted digital speech signals. The spectrum envelope synthesis filter has a first transfer function $H_s(Z)$ given by:

$$H_z(Z) = 1/\left(1 - \sum_{i}^{P} a_i Z^{-i}\right),$$

where P represents an order of the spectrum envelope synthesis filter. Let an order of the pitch reproduction filter be equal to unity, the pitch reproduction filter has a second transfer function $H_p(Z)$ given by:

$$H_p(Z) = 1/(1 - bZ^{-M}).$$

Let impulse responses of the spectrum envelope synthesis filter, the pitch reproduction filter, and the perceptual weighting filter be represented by $h_s(n)$, $h_p(n)$, and $w(n)$, respectively. The primary pulse producing unit 12 calculates an impulse response $h_w(n)$ of a cascade connection filter of the spectrum envelope synthesis filter and the pitch reproduction filter in a manner disclosed in Japanese Unexamined Patent Publication No. Syō 60-51900, namely, 51900/1985 which may be called a third reference. The impulse response $h_w(n)$ is given by:

$$h_w(n)=h_s(n)*h_p(n)*w(n), \quad (1)$$

where * represents convolution. An impulse response $h_{ws}(n)$ of the spectrum envelope synthesis filter which are subjected to perceptual weighting is given by:

$$h_{ws}(n)=h_s(n)*w(n). \quad (2)$$

The primary pulse producing unit 12 further calculates an autocorrelation function $R_{hh}(m)$ of the impulse response $h_w(n)$ and a cross-correlation function $\Phi_{hx}(m)$ between the weighted digital speech signals and the impulse resonse $h_w(n)$ in a manner described in the third reference.

Referring to FIG. 2 in addition to FIG. 1, the primary pulse calculator at first divides a single one of the frames into a predetermined number of subframes or pitch periods each of which is shorter than each frame of the input digital speech signal X(n) illustrated in FIG. 2(*a*). To this end, the average pitch period is calculated in the primary pulse calculator in a known manner and is depicted at M in FIG. 2(*b*). The illustrated frame is divided into first through fifth subframes $sf_1$ to $sf_5$. Subsequently, one of the subframes is selected as a representative subframe or duration in the primary pulse calculator by a method of searching for the representative subframe.

Specifically, the primary pulse calculator calculates a predetermined number L of prediction excitation multipulses at the first subframe $sf_1$, as illustrated in FIG. 2(*c*). The predetermined number L is equal to four in FIG. 2(*c*). Such a calculation of the excitation multipulses can be carried out by the use of the cross-correlation function $\Phi_{xh}(m)$ and the autocorrelation function $R_{hh}(m)$ in accordance with methods described in the first and the second references and in a paper contributed by Araseki, Ozawa, and Ochiai to GLOBECOM 83, IEEE Global Telecommunications Conference, No. 23.3, 1983 and entitled "Multi-pulse Excited Speech Coder Based on Maximum Cross-correlation Search Algorithm". The paper will be referred to as a fourth reference hereinafter. At any rate, the prediction excitation multipulses are specified by amplitudes $g_i$ and locations $m_i$ where i represents an integer between unity and L, both inclusive. The primary pulse calculator produces the locations and amplitudes of the prediction execution pulses as primary sound source signals.

Supplied with the prediction excitation multipulses, the pitch reproduction filter reproduces a plurality of primary excitation multipulses with respect to remaining subframes. The primary excitation multipulses are shown in FIG. 2(*d*). Supplied with the primary excitation multipulses, the spectrum envelope synthesis filter synthesizes the primary excitation multipulses and produces a sequence of primary synthesized signals X'(n).

The subtracter 14 subtracts the primary synthesized signals X'(n) from the input digital speech signals X(n) and produces a sequence of difference signals e(n) representative of differences between the input digital signals X(n) and the primary synthesized signals X'(n). Supplied with the difference signals e(n), the secondary pulse producing unit 13 calculates secondary excitation multipulses of a preselected number Q, for example, seven, for a single frame in the manner known in the art. The secondary excitation multipulses are shown in FIG. 2(*e*). The secondary pulse producing unit 13 produces the locations and the amplitudes of the secondary excitation multipulses as secondary sound source signals.

Thus, the encoding device produces the LPC parameters representative of the spectrum envelope, the pitch parameters representative of the pitch coefficients b and the average pitch period M, the primary sound source signals representative of the locations and the amplitudes of the prediction excitation multipulses of the number L, and the secondary sound source signals representative of the locations and the amplitudes of the secondary excitation multipulses of the number Q.

Figure 3:
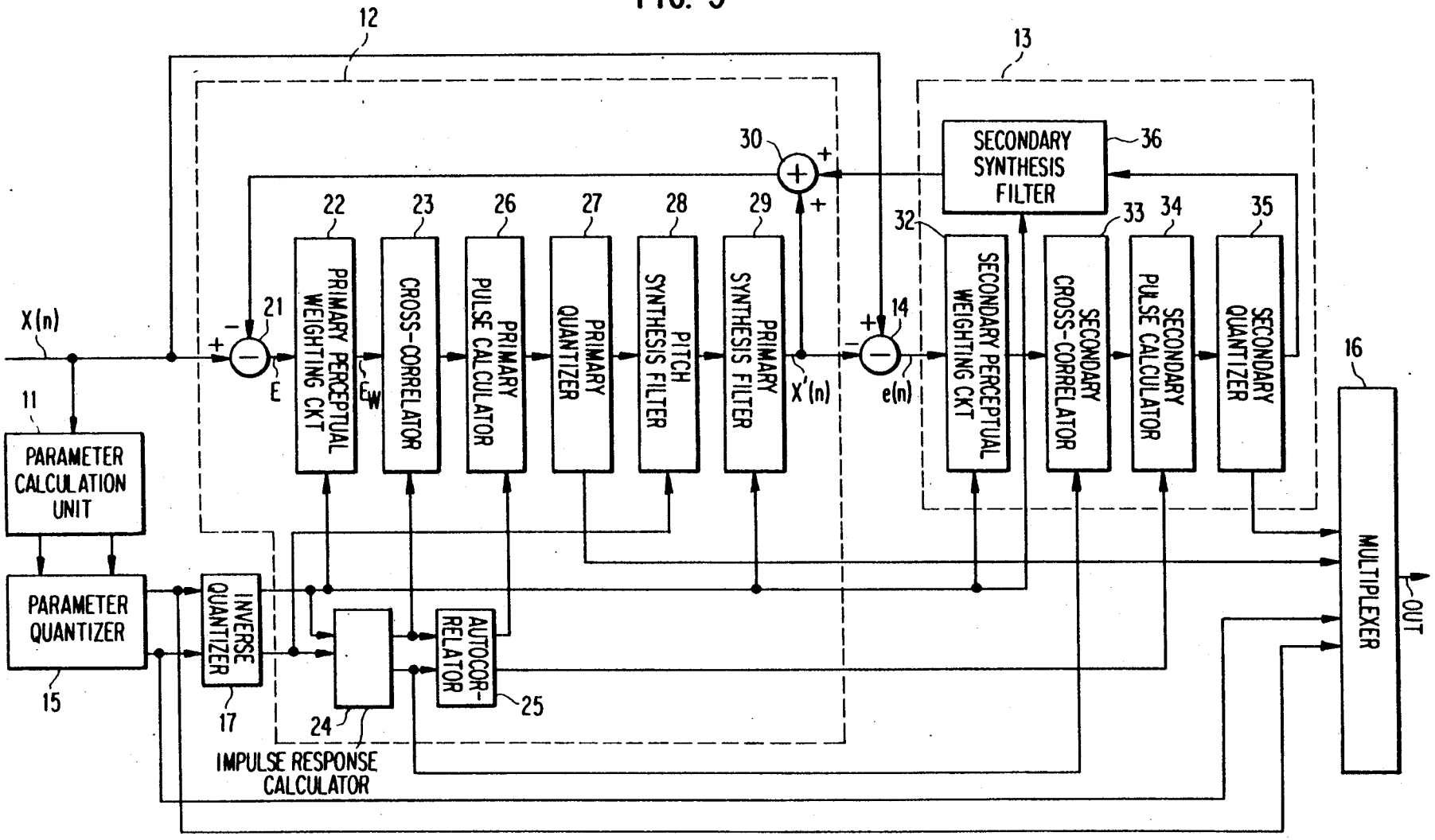
FIG. 3 is a block diagram of an encoder device according to a first embodiment of this invention.

Referring to FIG. 3, an encoder device according to a first embodiment of this invention comprises a parameter calculation unit, primary and secondary pulse producing units which are designated by like reference numerals shown in FIG. 1 and is supplied with a sequence of input digital speech signals X(n) to produce a sequence of output signals OUT. The input digital speech signal sequence X(n) is divisible into a plurality of frames and is assumed to be sent from an external device, such as an analog-to-digital converter (not shown) to the encoder device. Each frame may have an interval of, for example, 20 milliseconds. The input digital speech signals X(n) is supplied to the parameter calculation unit 11 at every frame. The illustrated parameter calculation unit 11 comprises an LPC analyzer (not shown) and a pitch parameter calculator (not shown) both of which are given the input digital speech signals X(n) in parallel to calculate spectrum parameters $a_i$, namely, the LPC parameters, and pitch parameters in a known manner. The spectrum parameters $a_i$ and the pitch parameters will be referred to as first and second primary parameter signals, respectively.

Specifically, the spectrum parameters $a_i$ are representative of a spectrum envelope of the input digital speech signals X(n) at every frame and may be collectively called a spectrum parameter. The LPC analyzer analyzes the input digital speech signals by the use of the linear predicting coding technique known in the art to calculate only first through N-th orders of spectrum parameters. Calculation of the spectrum parameters are described in detail in the first and the second reference which are referenced in the preamble of the instant specification. The spectrum parameters are identical with PARCOR coefficients. At any rate, the spectrum parameters calculated in the LPC analyzer are sent to a parameter quantizer 15 and are quantized into quantized spectrum parameters each of which is composed of a predetermined number of bits. Alternatively, the quantization may be carried out by the other known methods, such as scalar quantization, and vector quantization. The quantized spectrum parameters are delivered to a multiplexer 16. Furthermore, the quantized spectrum parameters are converted by an inverse quantizer 17 which carries out inverse quantization relative to quantization of the parameter quantizer 15 into converted spectrum parameters $a_i'$ ($i=1\sim N$). The converted spectrum parameters $a_i'$ are supplied to the primary pulse producing unit 12. The quantized spectrum parameters and the converted spectrum parameters $a_i'$ come from the spectrum parameters calculated by the LPC analyzer and are produced in the form of electric signals which may be collectively called a first parameter signal.

In the parameter calculation unit 11, the pitch parameter calculator calculates an average pitch period M and pitch coefficients b from the input digital speech signals X(n) to produce, as the pitch parameters, the average pitch period M and the pitch coefficients b at every frame by an autocorrelation method which is also described in the first and the second references and which therefore will not be mentioned hereinunder. Alternatively, the pitch parameters may be calculated by the other known methods, such as a cepstrum method, a SIFT method, a modified correlation method. In any event, the average pitch period M and the pitch coefficients b are also quantized by the parameter quantizer 15 into a quantized pitch period and quantized pitch coefficients each of which is composed of a preselected number of bits. The quantized pitch period and the quantized pitch coefficients are sent as electric signals. In addition, the quantized pitch period and the quantized pitch coefficients are also converted by the inverse quantizer 17 into a converted pitch period M' and converted pitch coefficients b' which are produced in the form of electric signals. The quantized pitch period and the quantized pitch coefficients are sent to the multiplexer 16 as a second parameter signal representative of the pitch period and the pitch coefficients.

In the example being illustrated, the primary pulse producing unit 12 is supplied with the input digital speech signals X(n) at every frame along with the converted spectrum parameters $a_i'$, the converted pitch period M' and the converted pitch coefficients b' to produce a set of primary sound source signals in a manner to be described later. To this end, the primary pulse producing unit 12 comprises an additional subtracter 21 responsive to the input digital speech signals X(n) and a sequence of local reproduced speech signals Sd to produce a sequence of error signals E representative of differences between the input digital and the local reproduced speech signals X(n) and Sd. The error signals E are sent to a primary perceptual weighting circuit 22 which is suppled with the converted spectrum parameters $a_i'$. In the primary perceptual weighting circuit 22, the error signals E are weighted by weights which are determined by the converted spectrum parameters $a_i'$. Thus, the primary perceptual weighting circuit 22 calculates a sequence of weighted errors in a known manner to supply the weighted errors Ew to a cross-correlator 23.

On the other hand, the converted spectrum parameters $a_i'$ are also sent from the inverse quantizer 17 to an impulse response calculator 24. Responsive to the converted spectrum parameters $a_i'$, the impulse response calculator 24 calculates, in accordance with the above-mentioned equation (2), the impulse response $h_{ws}(n)$ of a synthesis filter which are subjected to perceptual weighting and which is determined by the converted spectrum parameters $a_i'$. Responsive to the converted pitch period M' and the converted pitch coefficients b', the impulse response calculator 24 also calculates, in accordance with the afore-mentioned equation (1), the impulse response $h_w(n)$ of a cascade connection filter of a pitch synthesis filter and the synthesis filter which are subjected to perceptual weighting and which is determined by the converted spectrum parameters $a_i'$, the converted pitch period M', and the converted pitch coefficients b'. The impulse response $h_{ws}(n)$ thus calculated is delivered to both the cross-correlator 23 and an autocorrelator 25.

The cross-correlator 23 is given the weighted errors Ew and the impulse response $h_w(n)$ to calculate a cross-correlation function or coefficients $\Phi_{xh}(m)$ for a predetermined number N of samples in a well known manner, where m represents an integer selected between unity and N, both inclusive.

The autocorrelator 25 calculates a primary autocorrelation or covariance function or coefficient $R_{hh}(n)$ of the impulse response $h_w(n)$. The primary autocorrelation function $R_{hh}(n)$ is delivered to a primary pulse calculator 26 along with the cross-correlation function $\Phi_{xh}(m)$. The autocorrelator 25 also calculates a secondary autocorrelation function $R_{hhs}(n)$ of the impulse response $h_{ws}(n)$. The secondary autocorrelation function $R_{hhs}(n)$ is delivered to the secondary pulse producing unit 13 along with the converted spectrum parameters $a_i'$. The cross-correlator 23 and the autocorrelator 25 may be similar to that described in the third reference and will not be described any longer.

With reference to the converted pitch period M', the primary pulse calculator 26 at first divides a single one of the frames into a predetermined number of subframes or pitch periods each of which is shorter than each frame, as described in conjunction with FIG. 2. The primary pulse calculator 26 calculates, in accordance with the primary autocorrelation function $R_{hh}(n)$ and the cross-correlation function $\Phi_{xh}(m)$, the locations $m_i$ and the amplitudes $g_i$ of prediction excitation multipulses of a predetermined number L with respect to a preselected one of subframes. The primary pulse calculator 26 may be similar to that described in the third reference.

A primary quantizer 27 quantizes, at first, the locations and the amplitudes of the prediction excitation multipulses and supplies quantized locations and quantized amplitudes, as primary sound source signals, to the multiplexer 16. Subsequently, the primary quantizer 27 converts the quantized locations and the quantized amplitudes into converted locations and converted amplitudes by inverse quantization relative to the quantization and delivers the converted locations and amplitudes to a pitch synthesis filter 28 having the transfer function $H_p(z)$. Supplied with the converted locations and amplitudes, the pitch synthesis filter 28 reproduces a plurality of primary excitation multipulses with respect to remaining subframes in accordance with the converted pitch period M' and the converted pitch coefficients b'. With reference to the converted spectrum parameters $a_i'$, a primary synthesis filter 29 having the transfer function $H_s(z)$ synthesizes the converted locations and amplitudes and produces a sequence of primary synthesized signals X'(n). The subtracter 14 subtracts the primary synthesized signals X'(n) from the input digital speech signals X(n) and produces difference signals e(n) representative of differences between the input digital speech signals X(n) and the primary synthesized signals X'(n).

The secondary pulse producing unit 13 may be similar to that described in the third reference and comprises a secondary perceptual weighting circuit 32, a secondary cross-correlator 33, a secondary pulse calculator 34, a secondary quantizer 35, and a secondary synthesis filter 36. The difference signals e(n) are supplied to the secondary perceptual weighting circuit 32 which is supplied with the converted spectrum parameters $a_i'$. The difference signals e(n) are weighted by weights which are determined by the converted spectrum parameters $a_i'$. The secondary perceptual weighting circuit 32 calculates a sequence of weighted difference signals to supply the same to the cross-correlator 33.

The cross-correlator 33 is given the weighted difference signals and the impulse response $h_{ws}(n)$ to calculate a secondary cross-correlation function $\Phi_{xhs}(m)$. The secondary pulse calculator 34 calculates locations and amplitudes of secondary excitation multipulses of the preselected number Q with reference to the secondary cross-correlation function $\Phi_{xhs}(m)$ and the secondary autocorrelation function $R_{hhs}(n)$. The secondary pulse calculator 34 produces the location and the amplitudes of the secondary excitation multipulses. The secondary quantizer 35 quantizes the locations and the amplitudes of the secondary excitation multipulses and supplies quantized locations and quantized amplitudes, as secondary sound source signals, to the multiplexer 16. Subsequently, the secondary quantizer 35 converts the quantized locations and the quantized amplitudes by inverse quantization relative to the quantization and delivers converted locations and converted amplitudes to the secondary synthesis filter 36. With reference to the converted spectrum parameters $a_i'$, the secondary synthesis filter 36 synthesizes the converted locations and amplitudes and supplies a sequence of secondary synthesized signals to the adder 30. The adder 30 adds the secondary synthesized signals to the primary synthesized signals X'(n) and produces the local reproduction signals Sd of an instant frame. The local reproduction signals Sd is used for the input digital speech signals of a next frame.

The multiplexer 16 multiplexes the quantized spectrum parameters, the quantized pitch period, the quantized pitch coefficients, the primary sound source signals representative of the quantized locations and amplitudes of the prediction excitation multipulses of the number L, and the secondary sound source signals representative of the quantized locations and amplitudes of the secondary excitation multipulses of the number 0 into a sequence of multiplexed signals and produces the multiplexed signals as the output signals OUT.

Figure 4:
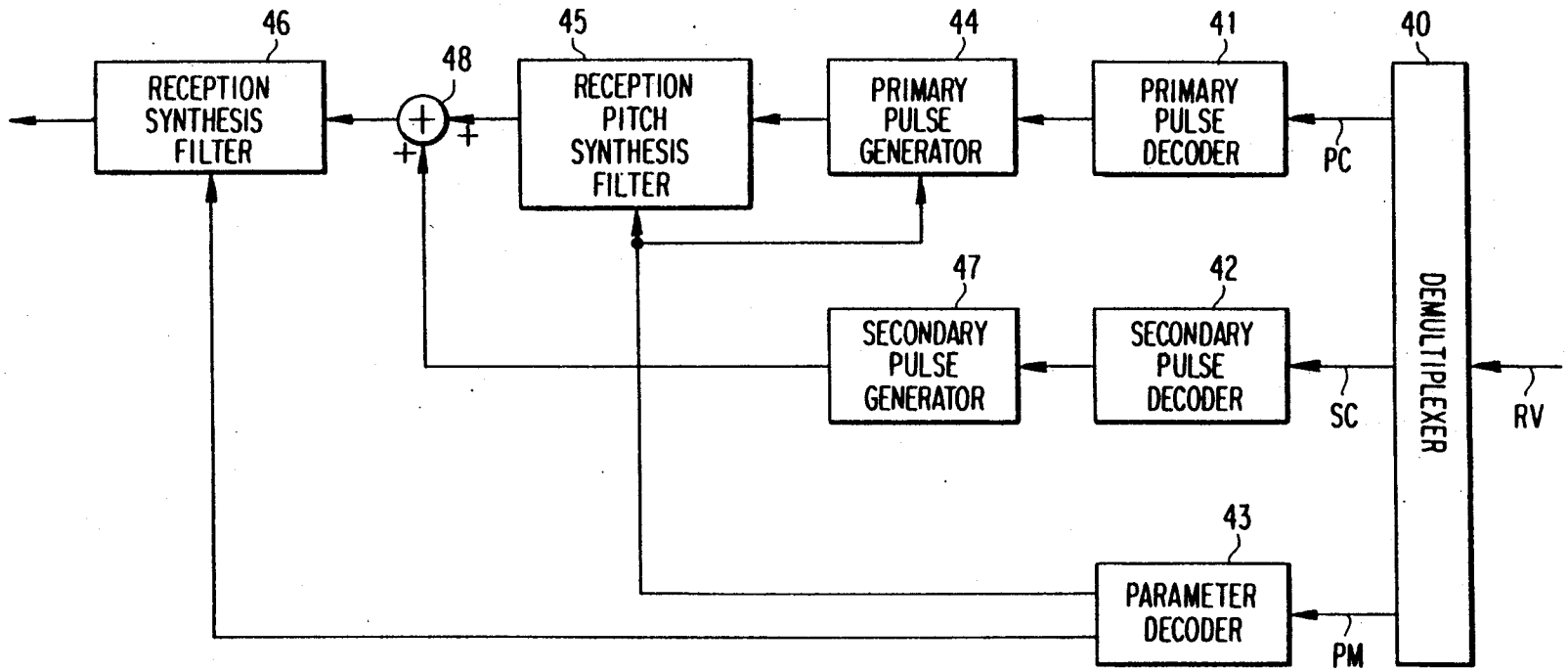
FIG. 4 is a block diagram of a decoder device which is communicable with the encoder device illustrated in FIG. 3 to form a communication system along with the encoder device.

Referring to FIG. 4, a decoding device is communicable with the encoding device illustrated in FIG. 3 and is supplied as a sequence of reception signals RV with the output signal sequence OUT shown in FIG. 3. The reception signals RV are given to a demultiplexer 40 and demultiplexed into primary sound source codes, secondary sound source codes, spectrum parameter codes, pitch period codes, and pitch coefficient codes which are all transmitted from the encoding device illustrated in FIG. 3. The primary sound source codes and the secondary sound source codes are depicted at PC and SC, respectively. The spectrum parameter codes, pitch period codes, and pitch coefficient codes may be collectively called parameter codes and are collectively depicted at PM. The primary sound source codes PC include the primary sound source signals while the secondary sound source codes SC include the secondary sound source signals. The primary sound source signals carry the locations and the amplitudes of the prediction excitation multipulses while the secondary sound source signals carry the locations and the amplitudes of the secondary excitation multipulses.

Supplied with the primary sound source codes PC, a primary pulse decoder 41 reproduces decoded locations and amplitudes of the prediction excitation multipulses carried by the primary sound source codes PC. Such a reproduction of the prediction excitation multipulses is carried out during the representative subframe. A secondary pulse decoder 42 reproduces decoded locations and amplitudes of the secondary excitation multipulses carried by the secondary sound source codes SC. Supplied with the parameter codes PM, a parameter decoder 43 reproduces decoded spectrum parameters, decoded pitch period, and decoded pitch coefficients. The decoded pitch period and the decoded pitch coefficients are supplied to a primary pulse generator 44 and a reception pitch reproduction filter 45. The decoded spectrum parameters are delivered to a reception synthesis filter 46. The parameter decoder 43 may be similar to the inverse quantizer 17 illustrated in FIG. 3. Supplied with the decoded locations and amplitudes of the prediction excitation multipulses, the primary pulse generator 44 generates a reproduction of the prediction excitation multipulses with reference to the decoded pitch period and supplies reproduced prediction excitation multipulses to the reception pitch reproduction filter 45. The reception pitch reproduction filter 45 is similar to the pitch reproduction filter 28 illustrated in FIG. 3 and reproduces a reproduction of the primary excitation multipulses with reference to the decoded pitch period and the decoded pitch coefficients. A secondary pulse generator 47 is supplied with the decoded locations and amplitudes of the secondary excitation multipulses and generates a reproduction of the secondary excitation multipulses for each frame. Supplied with reproduced primary excitation multipulses and reproduced secondary excitation multipulses, a reception adder 48 adds the reproduced primary excitation multipulses and reproduced secondary excitation multipulses and produces a sequence of driving sound source signals for each frame. The driving sound source signals are sent to the reception synthesis filter 46 along with the decoded spectrum parameters. The reception synthesis filter 46 is operable in a known manner to produce, at every frame, a sequence of synthesized speech signals.

Figure 5:
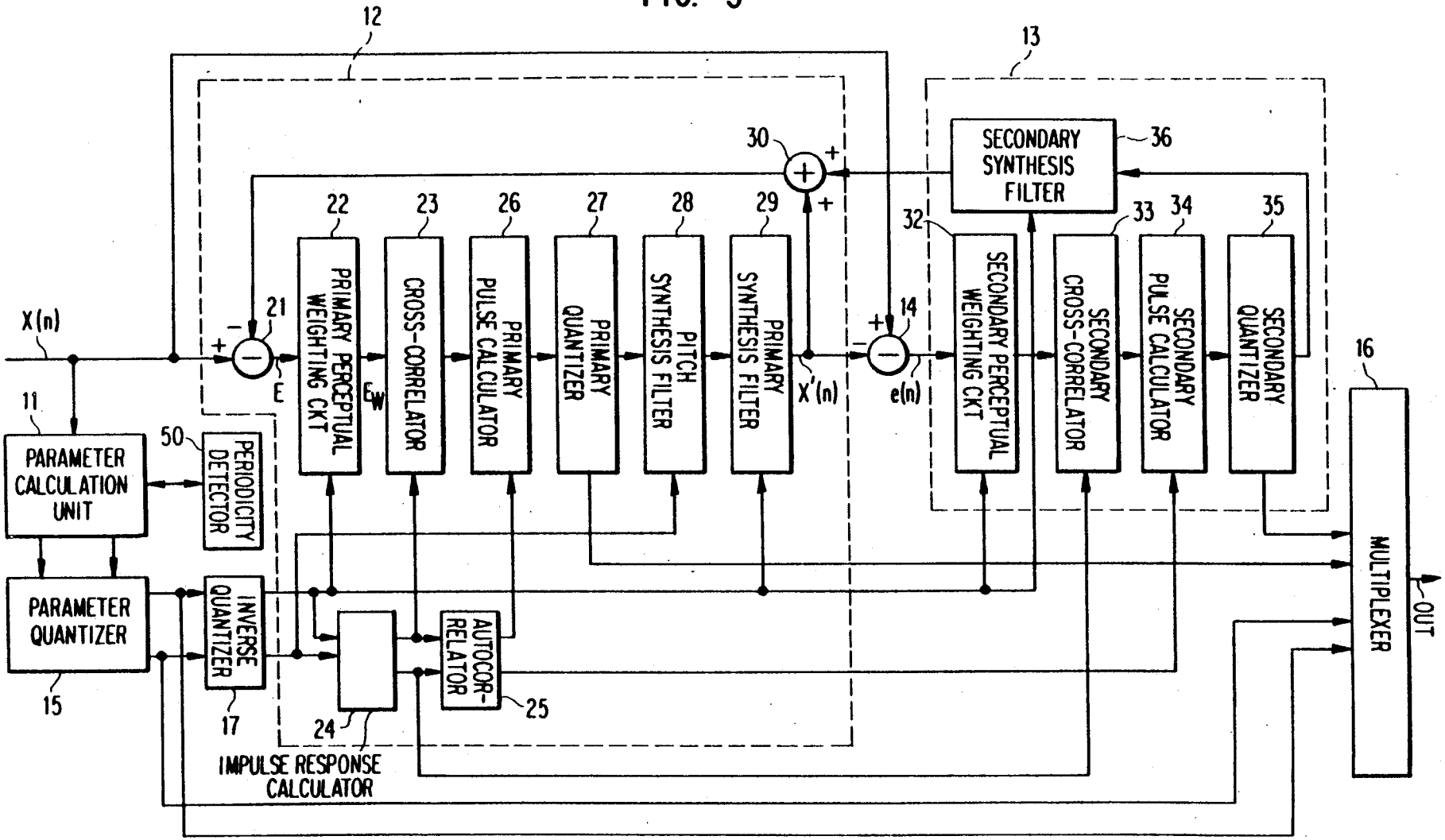
FIG. 5 is a block diagram of an encoder device according to a second embodiment of this invention.

Referring to FIG. 5, an encoding device according to a second embodiment of this invention is similar in structure and operation to that illustrated in FIG. 3 except that a periodicity detector 50. The periodicity detector 50 is operable in cooperation with a spectrum calculator, namely, the LPC analyzer in the parameter calculator 11 to detect periodicity of a spectrum parameter which is exemplified by the LPC parameters. To this end, the periodicity detector 50 detects linear prediction coefficients $a_i$, namely, the LPC parameters, and forms a synthesis filter by the use of the linear prediction coefficients $a_i$, as already suggested here and there in the instant specification. Herein, it is assumed that such a synthesis filter is formed in the periodicity detector 50 by the linear prediction coefficients $a_i$ analyzed in the LPC analyzer. In this case, the synthesis filter has a transfer function H(z) given by:

$$H(z) = 1/\left(1 - \sum_{i}^{P} a_i z^{-i}\right),$$

where P is representative of an order of the synthesized filter. Thereafter, the periodicity detector 50 calculates an impulse response h(n) of the synthesized filter is given by:

$$h(n) = \sum_{i}^{P} a_i h(n-i) + G\delta(n), (n \geqq 0),$$

where G is representative of an amplitude of an excitation source.

As known in the art, it is possible to calculate a pitch gain Pg from the impulse response h(n). Under the circumstances, the periodicity detector 50 further calculates the pitch gain Pg from the impulse response h(n) of the synthesis filter formed in the above-mentioned manner and thereafter compares the pitch gain Pg with a predetermined threshold level.

Practically, the pitch gain Pg can be obtained by calculating an autocorrelation function of h(n) for a predetermined delay time and by selecting a maximum value of the autocorrelation function that appears at a certain delay time. Such calculation of the pitch gain can be carried out in a manner described in the first and the second references and will not be mentioned hereinafter.

Inasmuch as the pitch gain Pg tends to increase as the periodicity becomes strong in the impulse response, the illustrated periodicity detector 50 detects that the periodicity of the impulse response in question is strong when the pitch gain Pg is higher than the predetermined threshold level. On detection of strong periodicity of the impulse response, the periodicity detector 50 weights the linear prediction coefficients $a_i$ by modifying $a_i$ into weighted coefficients $a_w$ given by:

$$a_w = a_i r^i \ (1 \leqq i \leqq p),$$

where r is representative of a weighting factor and is a positive number smaller than unity.

It is to be noted that a frequency bandwidth of the synthesis filter depends on the above-mentioned weighted coefficients $a_w$, especially, the value of the weighting factor r. Taking this into consideration, the frequency bandwidth of the synthesis filter becomes wide with an increase of the value r. Specifically, an increased bandwidth B (Hz) of the synthesis filter is given by:

$$B = -Fs/\pi . ln(r) \text{ (Hz)}.$$

Practically, when r and Fs are equal to 0.98 and 8 kHz, respectively, the increased bandwidth B is about 50 Hz.

From this fact, it is readily understood that the periodicity detector 50 produces the weighted coefficients $a_w$ when the pitch gain Pg is higher than the threshold level. As a result, the LPC analyzer produces weighted spectrum parameters. On the other hand, when the pitch gain Pg is not higher than the weighting factor r, the LPC analyzer produces the linear prediction coefficients $a_i$ as unweighted spectrum parameters.

Thus, the periodicity detector 50 illustrated in the encoding device detects the pitch gain from the impulse response to supply the parameter quantizer 15 with the weighted or the unweighted spectrum parameters. With this structure, the frequency bandwidth is widened in the synthesis filter when the periodicity of the impulse response is strong and the pitch gain increases. Therefore, it is possible to prevent a frequency bandwidth from unfavorably becoming narrow for the first order formant. This shows that the calculation of the excitation multipulses can be favorably carried out in reduced amount of calculations in the primary pulse producing unit 12 by the use of the prediction excitation multipulses derived from the representative subframe.

The primary and the secondary pulse producing units 12 and 13 and operation thereof are similar to those illustrated in FIG. 3. The description will therefore be omitted. Furthermore, a decoder device which is operable as a counterpart of the encoder device illustrated in FIG. 5 can use the decoder device illustrated in FIG. 4.

While this invention has thus far been described in conjunction with a few embodiments thereof, it will readily be possible for those skilled in the art to put this invention into practice in various other manners. For example, the pitch coefficients b may be calculated in accordance with the following equation given by:

$$E = \sum_{n}^{N} [\{X(n) - b \cdot v(n-T) * h_s(n)\} * w(n)]^2,$$

where v(n) represents previous sound source signals reproduced by the pitch reproduction filter and the synthesis filter and E, an error power between the input digital speech signals of an instant subframe and the previous subframe. In this event, the parameter calculator searches a location T which minimizes the above-described equation. Thereafter, the parameter calculator calculates the pitch coefficients b in accordance with the location T. The primary synthesis filter may reproduce weighted synthesized signals. In this event, the secondary perceptual weighting circuit 32 can be omitted. The secondary synthesis filter 36 and the adder 30 may be omitted.

What is claimed is:

1. In an encoder device supplied with a sequence of digital speech signals at every frame to produce a sequence of output signals, said encoder device comprising parameter calculation means responsive to said digital speech signals for calculating first and second primary parameters which specify a spectrum envelope and pitch parameters of the digital speech signals at every frame to produce first and second parameter signals representative of said spectrum envelope and said pitch parameters, respectively, calculation means coupled to said parameter calculation means for calculating a set of calculation result signals representative of said digital speech signals, and output signal producing means for producing said set of the calculation result signals as said output signal sequence, the improvement wherein said calculation means comprises:

primary pulse producing means responsive to said digital speech signals and said first and said second parameter signals for calculating a first set of prediction excitation multipulses with respect to a preselected one of subframes which result from dividing every frames and each of which is shorter than said frame, said primary pulse producing means producing said first set of prediction excitation multipulses, as a primary sound source signal, and a sequence of primary synthesized signals specified by said first set of prediction excitation multipulses and said spectrum envelope and said pitch parameters;

subtraction means coupled to said primary pulse producing means for subtracting said primary synthesized signals from said digital speech signals to produce a sequence of difference signals representative of differences between said primary synthesized signals and said digital speech signals;

secondary pulse producing means coupled to said subtraction means and responsive to said difference signals and said first and said second parameter signals for producing a second set of secondary excitation multipulses, as a secondary sound source signal, as said set of calculation result signals; and means for supplying a combination of said first set of prediction excitation multipulses, said second set of secondary excitation multipulses, and said first and said second parameter signals to said output signal producing means as said output signal sequence.

2. An encoder device as claimed in claim 1, wherein said primary pulse producing means comprises:

pulse calculation means for calculating said first set of prediction excitation multipulses with reference to said first and said second parameter signals;

pitch reproduction filter means coupled to said pulse calculation means for reproducing a third set of primary excitation multipulses with respect to remaining subframes except said preselected one of the subframes in accordance with said first set of prediction excitation multipulses and said second parameter signals; and primary synthesizing means coupled to said pitch reproduction filter means for synthesizing said third set of primary excitation multipulses with reference to said first parameter signal to produce said primary synthesized signals.

3. An encoder device as claimed in claim 2, further comprising:

periodicity detecting means coupled to said parameter calculation means and supplied with said first parameter signal for detecting whether or not periodicity of an impulse response of a synthesis filter determined by said first primary parameters is higher than a predetermined threshold level, said periodicity detecting means producing a weighting signal representative of a weighted value when said periodicity is higher than said predetermined level, said parameter calculation means weighting said first primary parameters in response to said weighted signal and producing first weighted parameter signals.

4. A decoder device communicable with the encoder device as claimed in claim 1 to produce a sequence of synthesized speech signals, said decoder device being supplied with said output signal sequence as a sequence of reception signals which carries said first set of prediction excitation multipulses, said second set of secondary excitation multipulses, and said first and said second primary parameters, said decoder device comprising:

demultiplexing means supplied with said reception signal sequence for demultiplexing said reception signal sequence into the first set of prediction excitation multipulses, the second set of secondary excitation multipulses, and the first and the second primary parameters as a first set of prediction excitation multipulse codes, a second set of secondary excitation multipulse codes, and first and second primary parameter codes, respectively;

decoding means coupled to said demultiplexing means for decoding said first set of predictioin excitation multipulse codes and said second set of secondary pulse codes into a first set of decoded prediction excitation multipulses and a second set of decoded secondary excitation multipulses, said first and said second parameter codes into first and second decoded parameters, respectively;

first pulse generating means responsive to said first set of decoded prediction excitation multipulses and said second decoded parameters for generating a first set of reproduced prediction excitation multipulses;

second pulse generating means responsive to said second set of decoded secondary excitation multipulses for generating a second set of reproduced secondary excitation multipulses;

pitch reproduction filter means responsive to said first set of reproduced prediction excitation multipulses and said second decoded parameters for reproducing a third set of reproduced excitation multipulses with respect to remaining subframes except said preselected one of the subframes;

adding means coupled to said pitch reproduction filter means and said second pulse generating means for adding said third set of reproduced excitation multipulses to said second set of reproduced secondary excitation multipulses to produce a sum signal representative of a sum of said third set of reproduced excitation multipulses and said second set of reproduced secondary excitation multipulses; and means coupled to said adding means and said reproducing means for synthesizing said sum signal into the synthesized speech signals in accordance with said first decoded parameters.

* * * * *

UNITED STATES PATENT AND TRADEMARK OFFICE

CERTIFICATE OF CORRECTION

PATENT NO. : 5,027,405

DATED : June 25, 1991

INVENTOR(S) : Kazunori Ozawa

It is certified that error appears in the above-identified patent and that said Letters Patent is hereby corrected as shown below:

Col. 4, line 59, delete "Hz" and insert --Hs--;

Col. 5, line 57, delete "execution" and insert --excitation--.

Signed and Sealed this

Ninth Day of March, 1993

*Attest:*

STEPHEN G. KUNIN

*Attesting Officer*

*Acting Commissioner of Patents and Trademarks*